US007166039B2

(12) United States Patent
Hettinger et al.

(10) Patent No.: US 7,166,039 B2
(45) Date of Patent: Jan. 23, 2007

(54) PUTTERHEAD WITH DUAL MILLED FACE PATTERN

(75) Inventors: Ronald K. Hettinger, Oceanside, CA (US); Wayne H. Byrne, Murrieta, CA (US); Lionel Poincenot, Carlsbad, CA (US)

(73) Assignee: Calaway Golf Company, Carlsbad, CA (US)

( * ) Notice: Subject to any disclaimer, the term of this patent is extended or adjusted under 35 U.S.C. 154(b) by 0 days.

(21) Appl. No.: 11/275,551

(22) Filed: Jan. 13, 2006

(65) Prior Publication Data

US 2006/0094534 A1 May 4, 2006

(51) Int. Cl.
*A63B 53/04* (2006.01)
*A63B 69/36* (2006.01)

(52) U.S. Cl. ..... 473/331; 473/340; 473/349; 473/249; 473/251

(58) Field of Classification Search ..... 473/330, 473/331, 251, 349, 340; D21/743, 750
See application file for complete search history.

(56) References Cited

U.S. PATENT DOCUMENTS 1,511,479 A * 10/1924 Kelly et al. ..... 473/330
1,965,954 A * 7/1934 Davis ..... 473/242
4,659,083 A 4/1987 Szczepanski
4,688,798 A 8/1987 Pelz
4,693,478 A 9/1987 Long
4,793,616 A 12/1988 Fernandez
4,964,641 A * 10/1990 Miesch et al. ..... 473/330
5,437,088 A * 8/1995 Igarashi ..... 29/527.6
5,458,332 A 10/1995 Fisher
5,460,377 A 10/1995 Schmidt et al.
5,464,218 A 11/1995 Schmidt et al.
5,470,068 A 11/1995 Schmidt et al.
5,485,997 A 1/1996 Schmidt et al.
5,575,472 A 11/1996 Magerman et al.
5,628,694 A 5/1997 O'Connor, Jr.
5,637,044 A * 6/1997 Swash ..... 473/331
5,674,132 A 10/1997 Fisher
5,688,186 A 11/1997 Michaels et al.
5,921,871 A 7/1999 Fisher
5,951,412 A 9/1999 Rose et al.
6,086,484 A 7/2000 Uebelhor
6,224,497 B1 * 5/2001 Antonious ..... 473/330
6,227,986 B1 5/2001 Fisher
6,257,994 B1 * 7/2001 Antonious ..... 473/331
6,309,310 B1 * 10/2001 Shira ..... 473/331
6,471,600 B1 * 10/2002 Tang et al. ..... 473/242
6,695,708 B1 2/2004 Fisher
6,893,358 B1 5/2005 Dewanjee et al.
6,905,420 B1 6/2005 Tang et al.
6,974,394 B1 12/2005 Tang et al.
6,984,181 B1 1/2006 Hettinger et al.
2002/0132683 A1 * 9/2002 Buchanan ..... 473/340

* cited by examiner

*Primary Examiner*—Sebastiano Passaniti
(74) *Attorney, Agent, or Firm*—Michael A. Catania; Elaine H. Lo

(57) ABSTRACT

A putter-head (20) with a body (22) having a striking face (24) is disclosed herein. The striking face (24) has a dual milled pattern thereon. Preferably, a central area (40) has a first milled pattern and a periphery region (42) has a second milled pattern. The body (22) is composed of a metal material, preferably a stainless steel material.

12 Claims, 5 Drawing Sheets

PUTTERHEAD WITH DUAL MILLED FACE PATTERN

CROSS REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to a putter-type golf club heads. More specifically, the present invention relates to a putter-type golf club head with a milled face.

2. Description of the Related Art

The milling of putter-heads is well-known in the golf industry. Computer Numerical Control (CNC) milling is also well-known in the golf industry.

U.S. Pat. No. 4,693,478 discloses a putter with a milled face.

U.S. Pat. No. 5,628,694 discloses a puffer with two identical milled lateral faces.

U.S. Pat. No. 5,688,186 discloses a golf club face with different regions of grooves.

An example of the milling of putters is disclosed at www.bettinardigolf.com, which discloses milled face putters.

BRIEF SUMMARY OF THE INVENTION

One aspect of the present invention is a putter-type golf club head having a body. The body is composed of a metal material and has a striking face for impacting a golf ball. The striking face has a first milled pattern and a second milled pattern. The first milled pattern is located in a central area of the striking face and the second milled pattern encompasses the central area. The second milled pattern is different from the first milled pattern.

Preferably, the first milled pattern comprises a plurality of milled parallel horizontal lines and the second milled pattern comprises a plurality of milled parallel vertical lines.

Alternatively, the first milled pattern comprises a plurality of milled parallel vertical lines and the second milled pattern comprises a plurality of milled parallel horizontal lines.

Alternatively, the first milled pattern comprises a plurality of milled parallel horizontal lines and the second milled pattern comprises a plurality of milled curved lines.

Each of the plurality of milled parallel horizontal lines of the first milled pattern preferably has a depth ranging from 0.0001 inch to 0.010 inch.

Further, each of the plurality of milled parallel horizontal lines of the first milled pattern preferably has a depth greater than the depth of each of the plurality of milled parallel vertical lines of the second milled pattern.

The body is preferably composed of a stainless steel material. Alternatively, the body is composed of a titanium material.

The first milled pattern preferably has an area ranging from 0.25 square inch to 1.0 square inch, and the striking face has a total surface area ranging from 2.5 square inches to 5.0 square inches.

Another aspect of the present invention is a putter-type golf club head having a body composed of a metal material. The body has a sole section, a crown section, and a striking face for impacting a golf ball. The striking face has a central area with a first milled pattern and a periphery area with a second milled pattern. The second milled pattern is different from the first milled pattern. The striking face has a total surface area ranging from 2.5 square inches to 5.0 square inches. The central area ranges from 20% to 60% of the total surface area of the striking face.

Yet another aspect of the present invention is a putter-type golf club head having a body composed of a metal material with a striking face have dual milled patterns. The body has a sole section, a crown section, and a striking face for impacting a golf ball. The striking face has a central area with a first milled pattern and a periphery area with a second milled pattern. The second milled pattern is different from the first milled pattern. The first milled pattern has a first plurality of milled lines having a depth ranging from 0.0005 inch to 0.010 inch, and the second milled pattern has a second plurality of milled lines having a depth ranging from 0.0005 inch to 0.010 inch, The striking face has a total surface area ranging from 2.5 square inches to 5.0 square inches. The central area ranges from 20% to 60% of the total surface area of the striking face.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
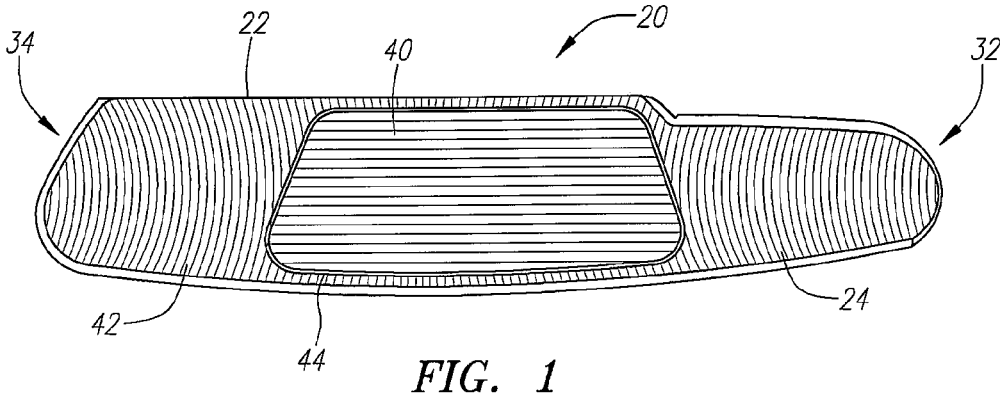
FIG. 1 is a front view of a putter-head.

As shown in FIGS. 1–7, a putter-type club head is generally designated 20. The club head 20 has a body 22 that is preferably composed of a metal material. A preferred metal for the body 22 is stainless steel. Alternative materials for the body 22 include titanium, titanium alloys, aluminum, aluminum alloys, magnesium, magnesium alloys, zinc, carbon steel, bronze, and the like. However, those skilled in the pertinent art will recognize that the body 22 may be composed of other materials without departing from the scope and spirit of the present invention.

The body 22 preferably weighs from 275 grams to 400 grams, more preferably from 300 grams to 350 grams, even more preferably from 315 grams to 335 grams and most preferably 328 grams.

The body 22 preferably has a striking face 24, a crown section 28, a sole section 30 and an optionally a hosel 26. A heel end 32 is opposite a toe end 34, and an aft-end 36 is opposite the striking face 24.

Figure 1A:
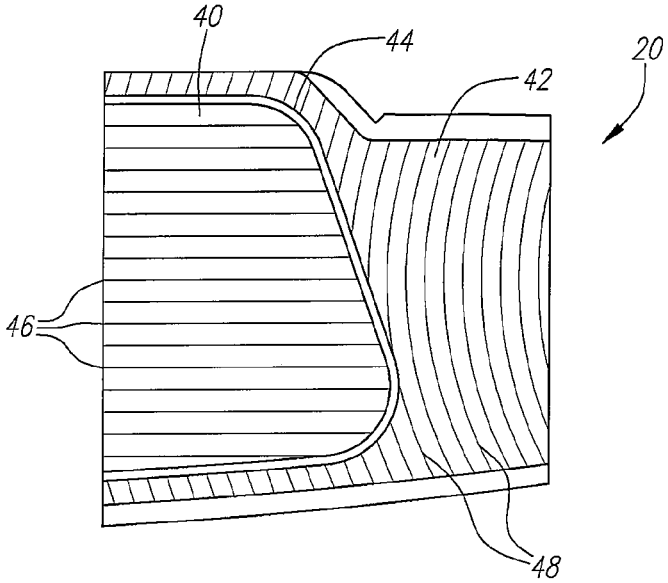
FIG. 1A is an enlarged partial view of the putter-head of FIG. 1.
Figure 2:
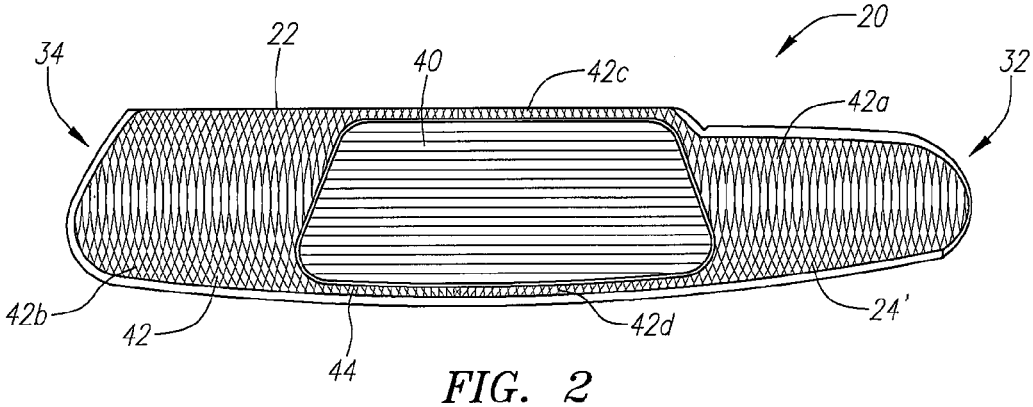
FIG. 2 is a front plan view of an alternative embodiment of a putter-head.
Figure 3:
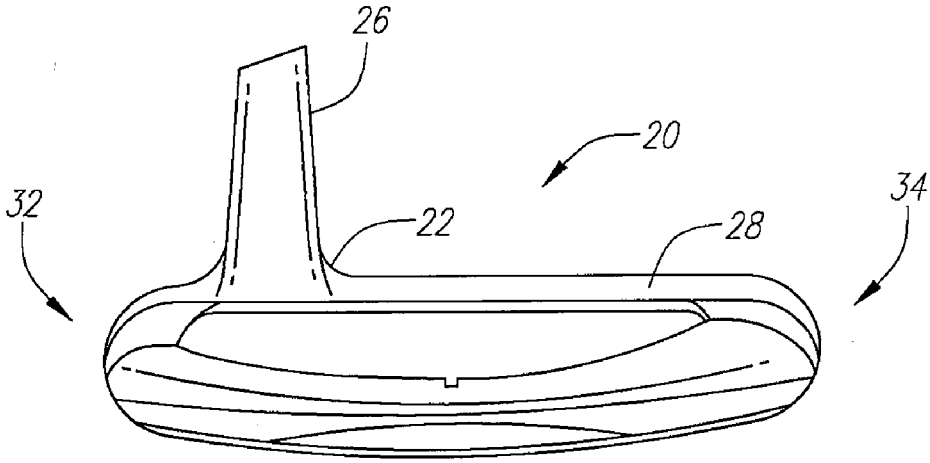
FIG. 3 is a rear view of a putter-head.
Figure 4:
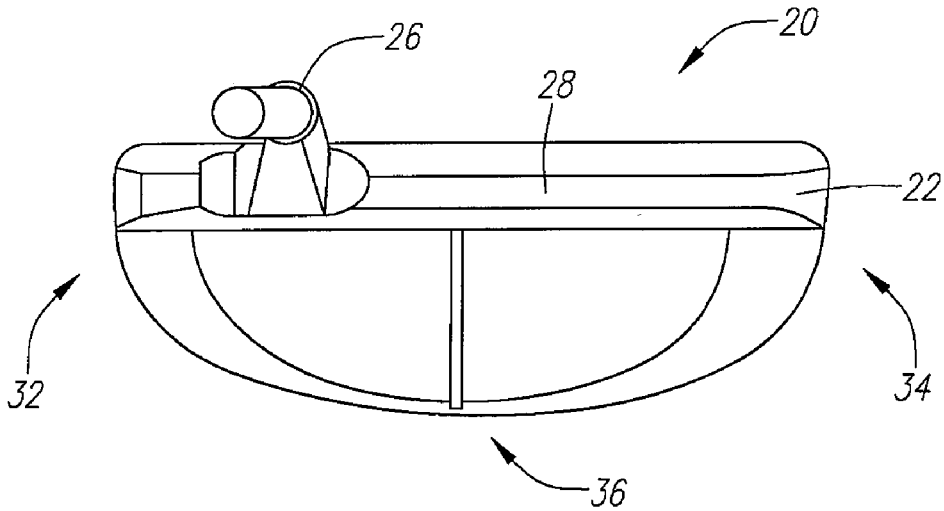
FIG. 4 is a top-plan view of a putter-head.
Figure 5:
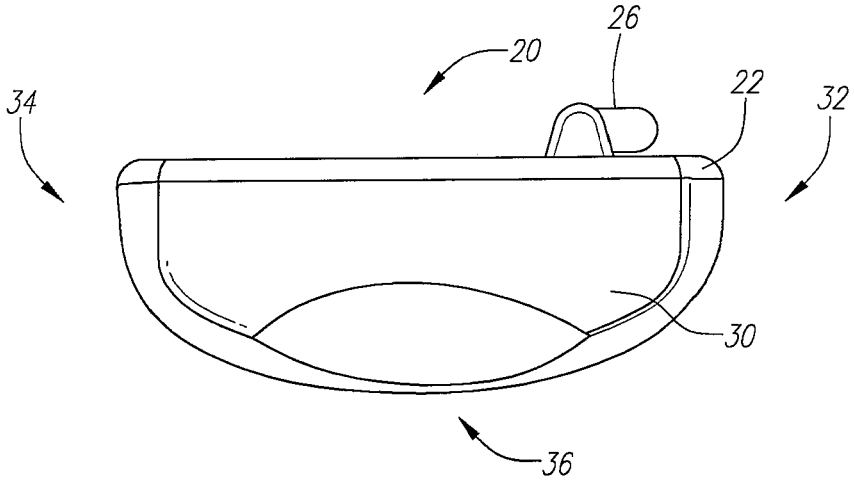
FIG. 5 is a bottom plan view of a putter-head.
Figure 6:
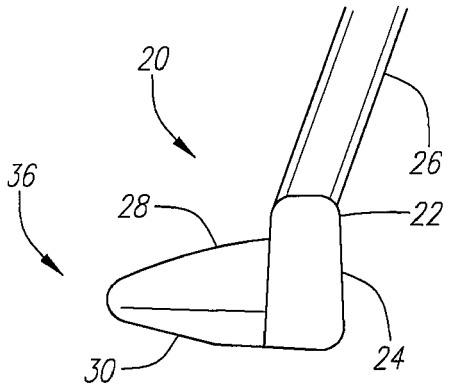
FIG. 6 is a toe-side view of a putter-head.
Figure 7:
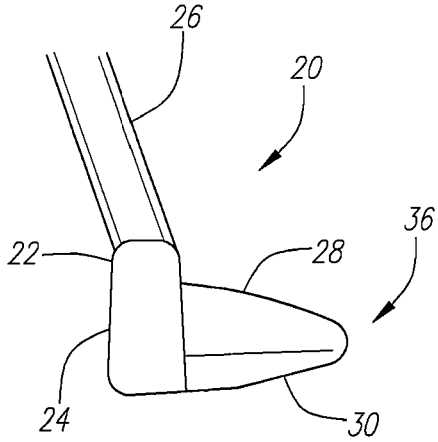
FIG. 7 is a heel-side view of a putter-head.
Figure 8:
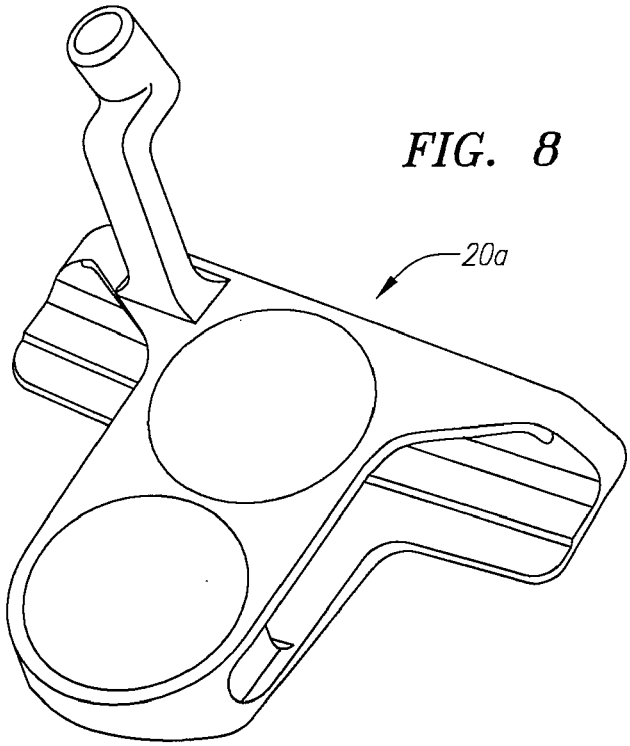
FIG. 8 is a top perspective view of a putter-head.
Figure 9:
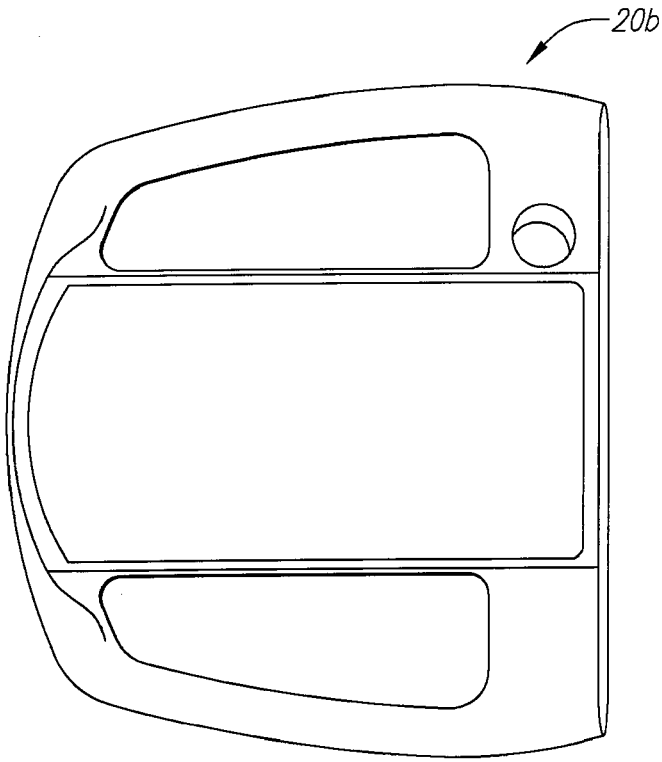
FIG. 9 is a top plan view of a putter-head.
Figure 10:
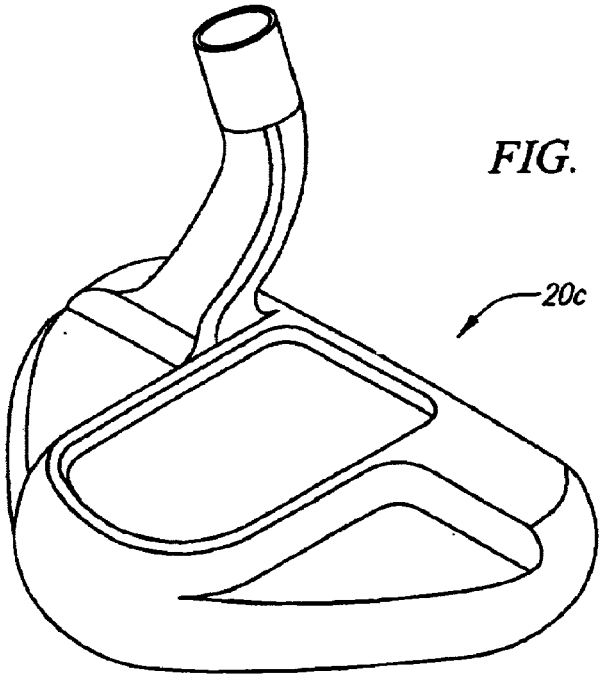
FIG. 10 is a top perspective view of a putter-head.
Figure 11:
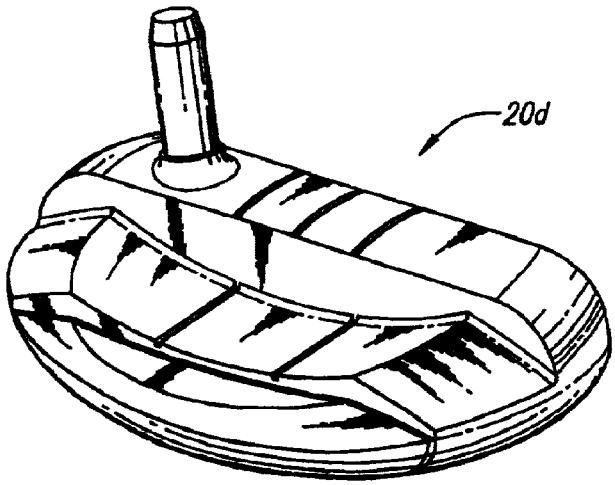
FIG. 11 is a top perspective view of a putter-head.

The striking face 24 preferably has a central area 40 and a periphery region 42. A perimeter 44 of the central area 40 generally defines a boundary between the central area 40 and the periphery region 42. The periphery region is preferably composed of a heel portion 42*a*, a toe portion 42*b*, a central crown portion 42*c* and a central sole portion 42*d*. As best shown in FIG. 1A, the central area 40 has a first milled pattern and the periphery region 42 has a second milled pattern which is different from the first milled pattern. The first milled pattern of the central area 40 has a first plurality of milled lines 46 having a depth ranging from 0.0001 inch to 0.010 inch, more preferably from 0.0003 inch to 0.001 inch, and most preferably about 0.0005 inch. The second milled pattern of the periphery region 42 has a second plurality of milled lines 48 having a depth ranging from 0.0001 inch to 0.010 inch, more preferably from 0.0003 inch to 0.001 inch, and most preferably about 0.0005 inch. Each of the first plurality of milled lines 46 and the second plurality of milled lines 48 is milled into the surface of the striking face 24, which is an integral part of the body 22. Each of the first plurality of milled lines 46 and the second plurality of milled lines 48 is preferably milled into the surface of the striking face 24 with a CNC milling apparatus.

In a preferred embodiment, the first plurality of milled lines 46 is a plurality of parallel horizontal lines 46, and the second plurality of milled lines 48 is a plurality of parallel curved vertical lines 48. Alternatively, the first plurality of milled lines 46 is a plurality of milled parallel vertical lines and the second plurality of milled lines 48 is a plurality of milled parallel horizontal lines. Alternatively, the first plurality of milled lines 46 is a plurality of milled parallel horizontal lines and the second plurality of milled lines 48 is a plurality of milled curved lines. Those skilled in the pertinent art will recognize that other combinations may be used for the first plurality of milled lines 46 and the second plurality of milled lines 48 without departing from the scope and spirit of the present invention.

The striking face 24 preferably has a total area that ranges from 2.5 square inches to 5.0 square inches. The central area 40 preferably has an area that ranges from 0.25 square inch to 2.5 square inches, and more preferably from 0.25 square inch to 1.0 square inch. The central area 40 preferably ranges from 20% to 60% of the total surface area of the striking face 24 with the entirety of the striking face 24 composed of the periphery region 42.

The putter-heads 20*a*–20*d* illustrated in FIGS. 8–11 are flanged blade, mallet and semi-mallet type putter-heads, however, those skilled in the art will recognize that other similar putter designs maybe utilized without departing from the scope and spirit of the present invention.

The putter-head 20 alternatively has an alignment means on a crown section 28. One such alignment means is disclosed in U.S. Pat. No. 6,471,600, entitled Putter Head, assigned to Callaway Golf Company, which pertinent parts are hereby incorporated by reference. Alternative alignment means are disclosed in U.S. Pat. No. 4,688,798, entitled Golf Club And Head Including Alignment Indicators, assigned to Callaway Golf Company, which pertinent parts are hereby incorporated by reference.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim:

1. A putter-type golf club head comprising:

a body composed of a metal material, the body having a striking face for impacting a golf ball, the striking face having a first milled pattern and a second milled pattern, the first milled pattern located in a central area of the striking face and the second milled pattern encompassing the central area, the second milled pattern different from the first milled pattern, wherein the first milled pattern comprises a plurality of milled parallel horizontal lines generally extending in a heel end to a toe end direction, and the second milled pattern comprises a plurality of milled curved lines.

2. The putter-type golf club head according to claim 1 wherein each of the plurality of milled parallel horizontal lines of the first milled pattern has a depth ranging from 0.0005 inch to 0.010 inch.

3. The puffer-type golf club head according to claim 1 wherein the body is composed of a stainless steel material.

4. The putter-type golf club head according to claim 1 wherein the body is composed of a titanium material.

5. The putter-type golf club head according to claim 1 wherein the first milled pattern has an area ranging from 0.25 square inch to 1.0 square inch, and the striking face has a total surface area ranging from 2.5 square inches to 5.0 square inches.

6. A putter-type golf club head comprising:

a body composed of a metal material, the body having a sole section, a crown section, and a striking face for impacting a golf ball, the striking face having a central area with a first milled pattern and a periphery area with a second milled pattern, the second milled pattern different from the first milled pattern, the striking face having a total surface area ranging from 2.5 square inches to 5.0 square inches, the central area ranging from 20% to 60% of the total surface area of the striking face.

7. The putter-type golf club head according to claim 6 wherein the first milled pattern comprises a plurality of milled parallel horizontal lines extending generally in a heel end to a toe end direction, and the second milled pattern comprises a plurality of milled curved lines.

8. The puffer-type golf club head according to claim 6 wherein the central area ranges from 30% to 45% of the total surface area of the striking face.

9. A putter-type golf club head comprising:

a body composed of a metal material, the body having a sole section, a crown section and a striking face for impacting a golf ball, the striking face having a central area with a first milled pattern and a periphery area with a second milled pattern, the second milled pattern different from the first milled pattern, the first milled pattern comprising a first plurality of milled lines having a depth ranging from 0.0005 inch to 0.010 inch, the second milled pattern comprising a second plurality of milled lines having a depth ranging from 0.0005 inch to 0.010 inch, the periphery area encompassing the central area, the striking face having a total surface area ranging from 2.5 square inches to 5.0 square inches, the central area ranging from 20% to 60% of the total surface area of the striking face.

10. The puffer-type golf club head according to claim 9 wherein the crown section further comprises an alignment device, the alignment device selected from the group consisting of a plurality of aligned circles, a plurality of aligned chevrons and a plurality of parallel lines extending rearward from the striking face.

11. The putter-type golf club head according to claim 9 wherein the body is composed of a metal material selected form the group consisting of stainless steel, titanium, titanium alloy, aluminum alloy, aluminum, magnesium and magnesium alloy.

12. The putter-type golf club head according to claim 9 wherein the periphery region comprises a toe portion, a heel portion, a central crown portion and a central sole portion.

* * * * *